United States Patent [19]

Pluim

[11] 4,200,139

[45] Apr. 29, 1980

[54] LINEAR PERMANENT MOULD CASTING SYSTEM

[75] Inventor: Cornelius Pluim, Puslinch, Canada

[73] Assignee: Cast-Tec Ltd., Oakville, Canada

[21] Appl. No.: 971,760

[22] Filed: Dec. 21, 1978

[30] Foreign Application Priority Data

Feb. 2, 1978 [CA] Canada ..... 296175

[51] Int. Cl.[2] ..... B22D 29/00; B22D 47/00

[52] U.S. Cl. ..... 164/72; 164/269; 164/323

[58] Field of Search ..... 164/72, 130, 267, 269, 164/270, 322, 323, 324, 340

[56] References Cited

U.S. PATENT DOCUMENTS 1,033,254 7/1912 Lister ..... 164/130 X 1,319,673 10/1919 Stephenson ..... 164/269 X 1,622,875 3/1927 Lee ..... 164/72 X

FOREIGN PATENT DOCUMENTS 441101 6/1975 U.S.S.R. ..... 164/324

*Primary Examiner*—Robert D. Baldwin

*Attorney, Agent, or Firm*—Beveridge, DeGrandi, Kline & Lunsford

[57] ABSTRACT

A process relating to the pouring of ferrous metal into a permanent mould made of iron or other like material, automating said moulds within the system so as to offer diversification of production and while so doing having a finished product that is of a machinable and marketable nature. Slow cooling of the castings through the critical temperature in the system limits the formation of iron carbides and successfully produce a machinable product.

2 Claims, 4 Drawing Figures

SEE FIG. 2b 50
49
52
54
56
18
22
20
12
26
24
28

LINEAR PERMANENT MOULD CASTING SYSTEM

BACKGROUND OF THE INVENTION

This invention relates to a linear, permanent mould casting system and method of casting. The system according to the present invention may produce up to twenty-five different castings simultaneously and does not require as noisy and dirty a casting shakeout system as conventional sand moulding vastly improving foundry working conditions. A casting yield of a permanent mould process in accordance with the present invention is approximately ninety percent compared with seventy-five percent for a disamatic system. At a two million B.T.U. per ton energy requirement, permanent mould casting in accordance with the present invention is seventeen percent more efficient.

In a permanent mould system according to the present invention the mould walls are rigid and inert which not only improves casting yield but improves surface finish and dimensional control. Tolerances of plus or minus one sixty-fourth of an inch are possible which can reduce secondary machining considerably or in some cases even eliminate the operation.

There are disadvantages of known forms of permanent mould castings and in particular due to a rapid cooling rate, permanent mould castings are subject to chilling or the formation of iron carbides. This greatly reduces casting machinability. Additionally, permanent mould dies are expensive and have a definite life span.

The present invention provides great improvements over known systems in the provision of a casting machine or system which transports the permanent moulds through core setting, pouring and knockout stations. This reduces manpower costs substantially and also provides a reduction of in-plant pollutants which then are concentrated in one area and can be cleaned efficiently.

By pouring the castings in a designated area the molten iron can be innoculated just prior to pouring. Due to the fading effect of additives (magnesium, ferro-silicon etc.) the molten iron should be treated just prior to pouring which is only possible if the process utilizes a central pouring station in accordance with the present invention.

Permanent mould castings can be control cooled according to the present invention by being held at 1700° F. to 1800° F. for a short period of time (approximately fifteen minutes) immediately after solidification. This provides sufficient time to allow graphitization or reduction of chill to occur and yet the short holding time prevents warpage. An added advantage of this softening method is a substantial saving in energy in not having to bring the casting up to temperature and hold it there for several hours as is the case in the prior art. This method utilizes the removal of castings from the permanent moulds at a centralized location and the feeding thereof directly into a controlled cooling facility.

SUMMARY OF THE INVENTION

According to one broad aspect the present invention relates to a linear, permanent mould casting system having means for indexing and moving moulds to a plurality of stations and comprising in series: (a) a smoke station for coating a mould, (d) a core setting station, (c) a time reading station for registration of solidification time into a memory system, (d) a clamping station for securing the moulds in a closed position, (e) a pouring station for filling said moulds, (f) a cooling and unclamping station for opening said mould and releasing said casting, g) means for receiving and conveying said casting into a controlled cooling system, (h) a closed loop transport system for indexing a plurality of containers which are insulated and refractory lined with firing lid for castings requiring controlled cooling, (i) a heating system for preheating the insulated containers, (j) a slow-cooling tunnel having doors at each end for entrance and exit of castings and including a dumping frame to transfer castings from the containers into cooling containers and a second dumping frame to transfer the cooled castings from the exit end of the tunnel into a separation device, (k) a separating device for separating sand and castings and (l) a shuttle station for returning the mould wagon to said smoking station.

In accordance with another broad aspect, the invention relates to a process of producing castings in a permanent mould comprising the steps of (1) coating a mould at a smoke station with acetylene smoke, (2) forwarding said mould to a core setting station and placing a core in said mould and closing said mould, (3) indexing said mould to a time reading station and recording solidification time on said mould and registering said time into a memory, (4) moving said mould to a clamping station and clamping said mould in a closed position, (5) indexing said mould to a pour station and filling said mould with the molten metal and starting said solidification timing, (6) moving said mould into a cooling station, (7) unlatching said mould and dropping said casting onto a conveyor, (8) conveying said casting into a container placed at the discharge end of said conveyor, (9) moving a plurality of insulated containers to a heating system and preheating said containers for receiving said castings, (10) slow-cooling said castings in a cooling tunnel and including dumping said casting from the insulated container into a cooling container and at the other end of said tunnel dumping said casting from the cooling container into a separation device, (11) separating said casting from sand and sprue.

BRIEF DESCRIPTION OF THE DRAWINGS

The invention is illustrated by way of example in the accompanying drawings in which.

DETAILED DESCRIPTION OF THE DRAWINGS

Figure 1A:
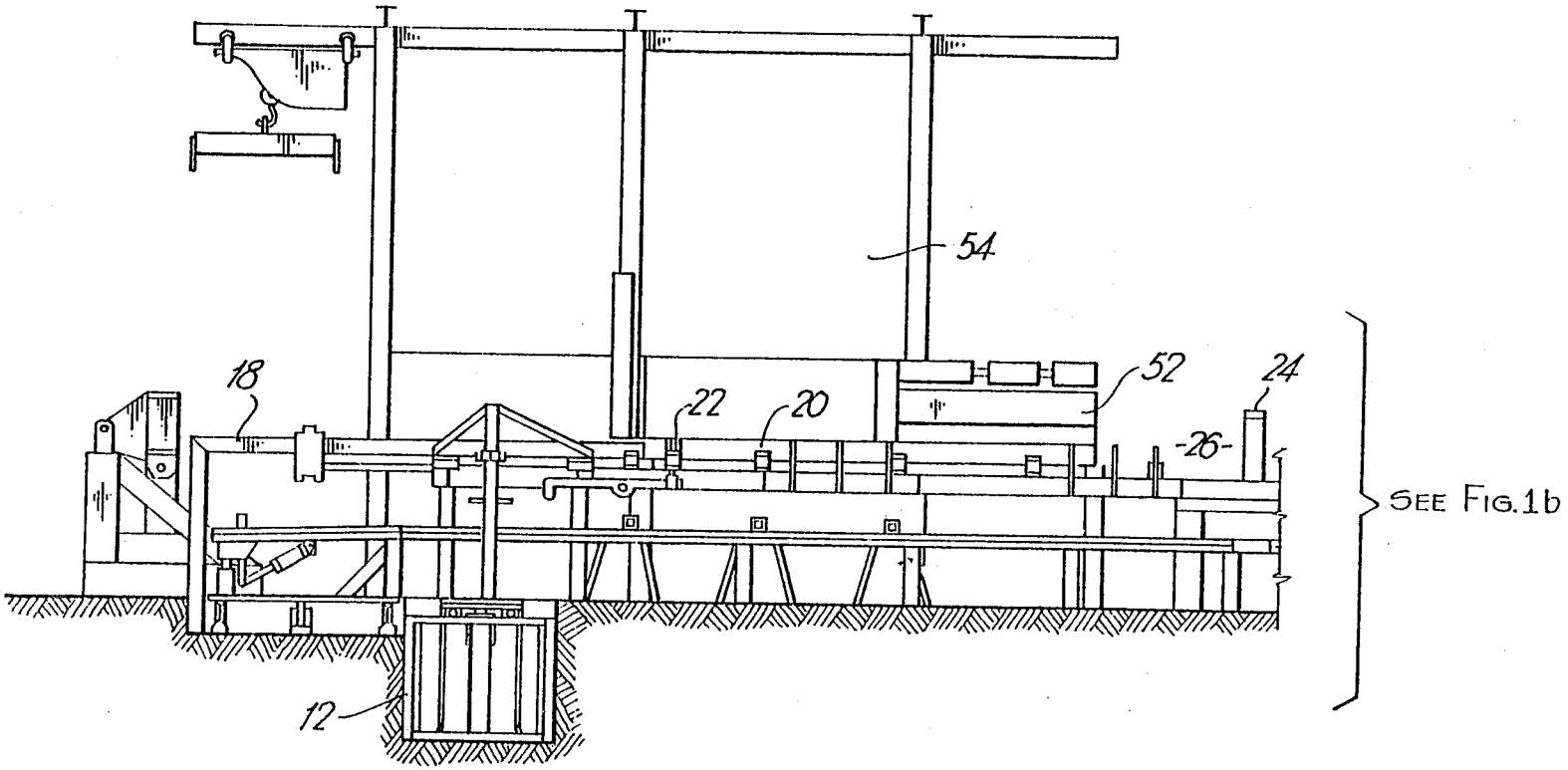
FIGS. 1*a* and 1*b* illustrate an elevation view of the linear permanent mould casting system according to the invention.
Figure 1B:
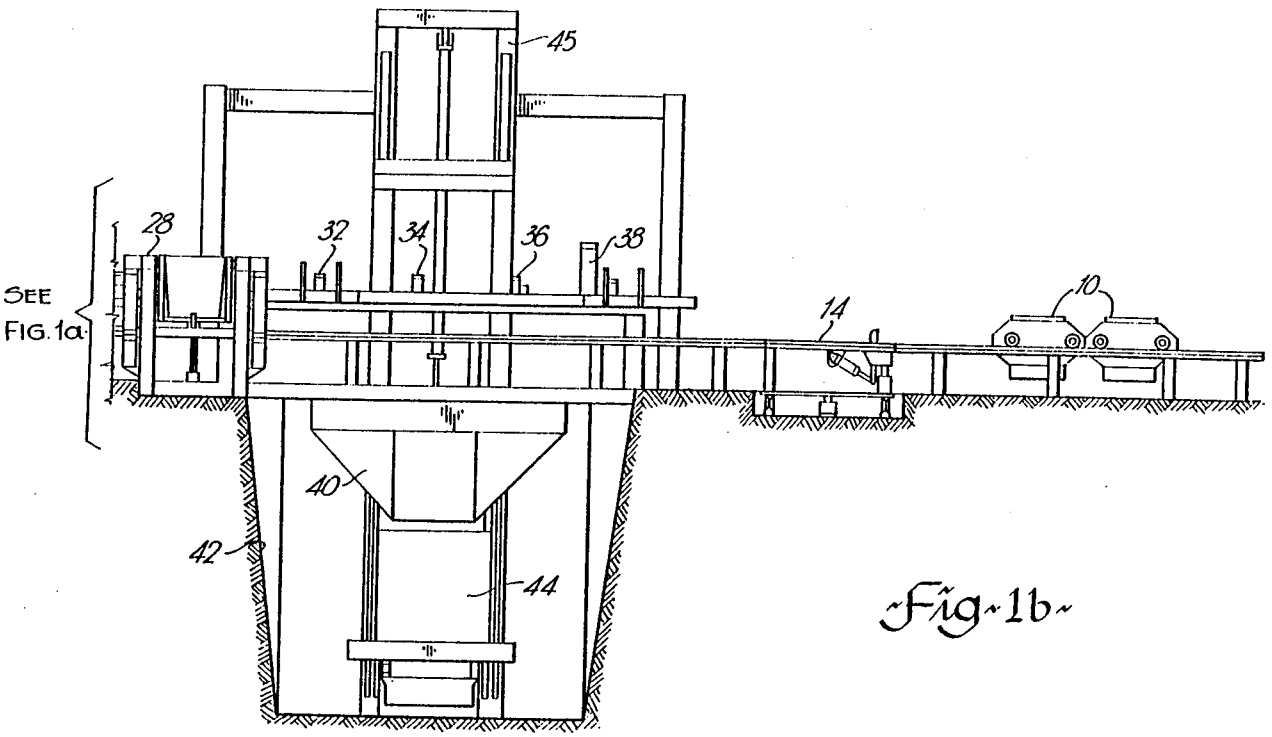
Figure 2A:
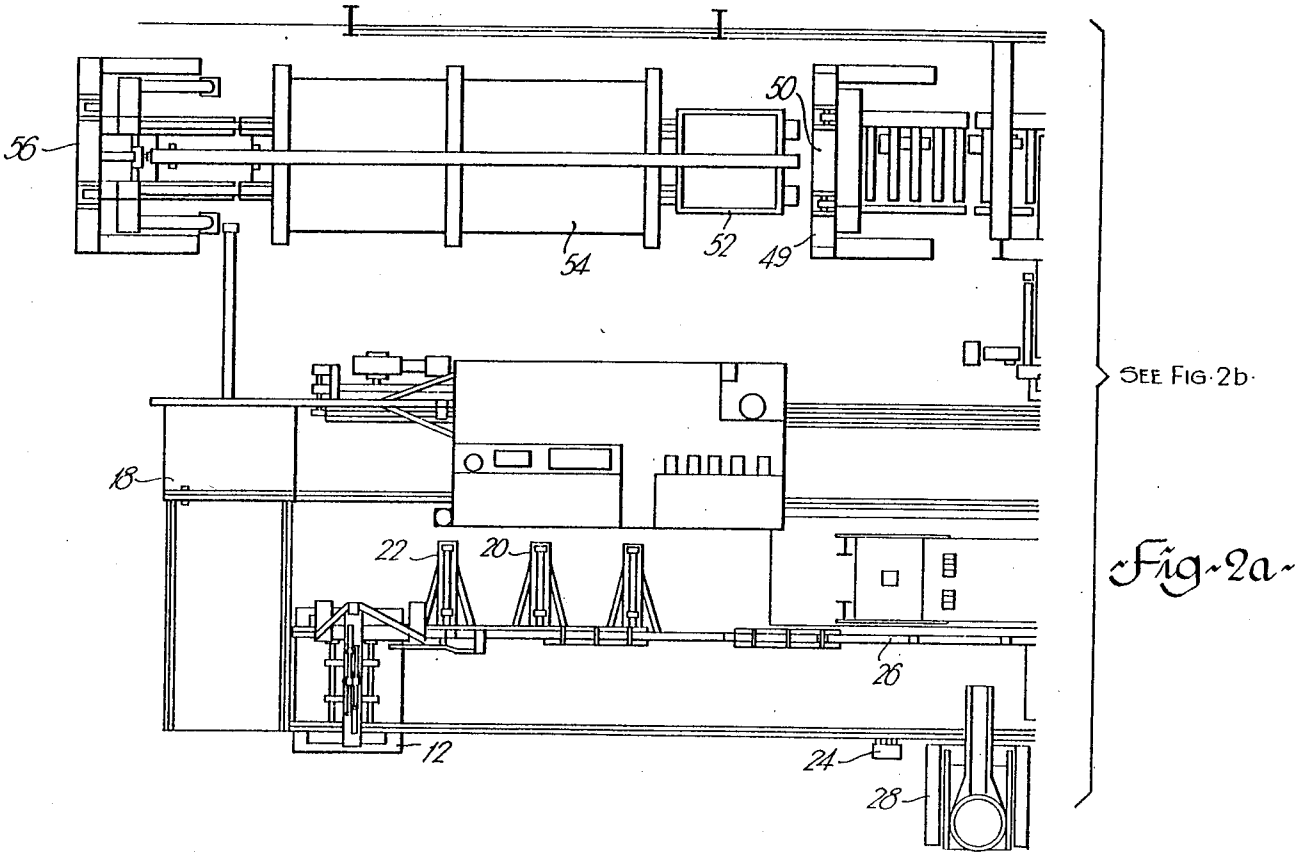
FIGS. 2*a* and 2*b* illustrate a plan view of the same.
Figure 2B:
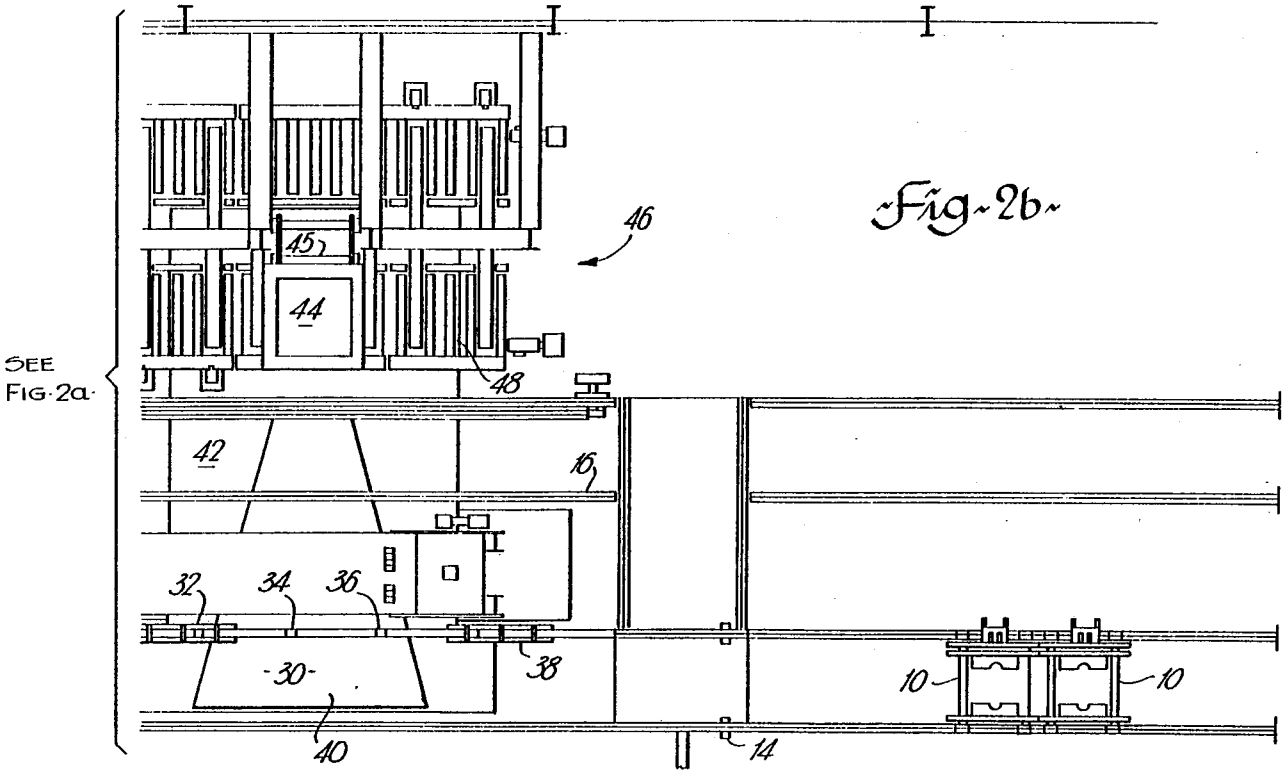

Referring to the FIGS. 2*a* and 2*b*, , the system incorporates a plurality of mould wagons 10 shown at the right hand end of the drawing and wagons 10 are conveyed through a linear circuit beginning at a smoke station 12 through to a shuttle station 14 where they are moved to a return track 16 and thence to another shuttle 18 to return to the smoke station 12. With a mould wagon 10 at the smoke station, the mould is coated with acetylene smoke and is moved by an indexing mechanism 20 to a core setting station 22 where a core is placed in the mould and the mould is closed. The wagon 10 is then indexed until it reaches a time reading station 24 where a solidification time is taken on the mould 10 and registered into a memory. The wagon 10 is then indexed into a clamping station 26 where clamping cylinders (not shown) are latched onto the mould to hold it in a closed position. The wagon is then indexed to a pour station 28 where after the start of pouring molten metal into the mould wagon, a timing mechanism is initiated. After the mould is filled, the wagon 10 is indexed out therefrom and into a cooling section 30 where depending upon the timing, moulds 10 will open at the first, second or third station 32, 34 or 36 and the casting will be ejected. The mould wagon continues to the unclamping or unlatching station 38 while the casting is dropped onto a pan conveyor 40 located in a pit 42 below the system to move the ejected castings and sand quickly into a container 44 placed at the discharge end.

A closed loop transport system 46 utilizing roller conveyor tracks 48, hydraulic cylinders and corner units and elevators is provided for indexing a plurality of containers such as 44 which are insulated and refractory lined with a firing lid for castings that require slow cooling. A heating system not shown consists of a plurality of burners mounted on stands for preheating the insulated containers before the castings shift. One of these burns is required throughout the casting shift to replace the heat loss through the container walls. The container progresses to a hot casting dump mechanism 49 including a dumping frame 50 for transferring castings from the insulated container into a cooling container 52 which is then transported through a cooling tunnel 54 equipped with doors at either end and having wheeled containers hydraulically indexed on rails between the dumping frames. The second dumping frame 56 is provided to transfer the cooled castings from the exit end of the cooling tunnel 54 into a separation device not shown comprising a vibrating conveyor with screen and receiving hopper into which is dumped the containers of castings and sand. Sand falling through the screen is removed by an inclined belt conveyor while the castings and sprue are discharged from the end to an apron conveyor for sorting into containers.

After the mould wagons are opened they are indexed into the shuttle 14, shuttled across and dumped onto the back track 16 and are then taken by power to the other end of the system where they are indexed into the shuttle 18 and moved across and dumped into the smoking station again.

I claim:

1. A linear, permanent mould casting system having means for indexing and moving mould wagons to a plurality of stations and comprising in series:

(a) a smoke station for coating the moulds, (b) a core setting station, (c) a time reading station for registration of solidification time into a memory system, (d) a clamping station for securing the moulds in a closed position, (e) a pouring station with means for filling said moulds, (f) a cooling and unclamping station for opening said moulds and releasing said castings, (g) means for receiving and conveying said castings into an insulated container, (h) a closed loop transport system with means for indexing a plurality of containers which are insulated and refractory lined with firing lid for castings requiring controlled cooling, (i) a heating system with means for preheating the insulated containers, (j) a slow-cooling tunnel adjacent said transport system having doors at each end for entrance and exit of castings and including a dumping frame to transfer castings from the insulated containers into cooling containers and a second dumping frame to transfer the cooled castings from the exit end of the tunnel, and (k) shuttle means for returning the mould wagon to said smoking station.

2. A process of producing castings in a permanent mould comprising the steps of (1) coating a mould at a smoke station with acetylene smoke, (2) forwarding said mould to a core setting station and placing a core in said mould and closing said mould, (3) indexing said mould to a solidification time reading station and recording time on said mould and registering said time into a memory, (4) moving said mould to a clamping station and clamping said mould in a closed position, (5) indexing said mould to a pour station and filling said mould with the molten metal and starting timing, (6) moving said mould into a cooling station, (7) unlatching said mould and dropping said casting onto a conveyor, (8) moving a plurality of insulated containers to a heating system and preheating said containers for receiving said castings, (9) conveying said casting into said container placed at the discharge end of said conveyor,

(10) slow-cooling said casting in a cooling tunnel and including dumping said casting from the insulated container into a cooling container and at the other end of said tunnel dumping said casting from the cooling container into a separation device,

(11) separating said casting from sprue.

* * * * *